US009931013B2

(12) United States Patent
Nonnenmann et al.

(10) Patent No.: US 9,931,013 B2
(45) Date of Patent: Apr. 3, 2018

(54) MANUALLY GUIDED FLOOR CLEANING MACHINE

(71) Applicant: Alfred Kärcher GmbH & Co. KG, Winnenden (DE)

(72) Inventors: Frank Nonnenmann, Schorndorf (DE); Melanie Ritscher, Rudersberg (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 911 days.

(21) Appl. No.: 14/261,697

(22) Filed: Apr. 25, 2014

(65) Prior Publication Data

US 2014/0230183 A1 Aug. 21, 2014

Related U.S. Application Data

(63) Continuation of application No. PCT/EP2011/069239, filed on Nov. 2, 2011.

(51) Int. Cl.
*A47L 5/00* (2006.01)
*A47L 11/40* (2006.01)

(52) U.S. Cl.
CPC ..... *A47L 11/4061* (2013.01); *A47L 11/4041* (2013.01)

(58) Field of Classification Search
CPC ..... A47L 11/4061; A47L 11/4041
USPC ..... 15/340.3
IPC ..... A47L 5/00
See application file for complete search history.

(56) References Cited

U.S. PATENT DOCUMENTS

| | | | |
|---|---|---|---|
| 2,229,229 | A | 1/1941 | Wagner |
| 2,842,788 | A | 7/1958 | Rench et al. |
| 3,006,021 | A | 10/1961 | Patch |
| 3,150,394 | A | 9/1964 | Sauers |
| 4,005,502 | A | 2/1977 | Stevens (Boyer) |
| 4,010,507 | A | 3/1977 | Johnson |
| 4,499,624 | A | 2/1985 | Bloome et al. |
| 6,041,472 | A | 3/2000 | Kasen et al. |
| 6,163,923 | A | 12/2000 | Hefter |
| 6,421,869 | B1 | 7/2002 | Olsson |
| 6,904,989 | B2 | 6/2005 | Hefter |
| 7,533,435 | B2 | 5/2009 | Pedlar et al. |
| 2002/0023666 | A1 | 2/2002 | Tawara et al. |
| 2009/0078485 | A1 | 3/2009 | Gutsch et al. |
| 2009/0281661 | A1 | 11/2009 | Dooley et al. |
| 2011/0023248 | A1 | 2/2011 | Tucker |

FOREIGN PATENT DOCUMENTS

| | | |
|---|---|---|
| CN | 2426328 | 4/2001 |
| CN | 102083352 | 6/2011 |
| DE | 43 37 633 | 5/1995 |
| DE | 198 55 101 | 9/2001 |
| DE | 20 2006 011 450 | 9/2006 |
| EP | 0 294 748 | 12/1988 |

(Continued)

*Primary Examiner* — David Redding
(74) *Attorney, Agent, or Firm* — Womble Bond Dickinson (US) LLP

(57) ABSTRACT

A manually guided floor cleaning machine is provided, including a chassis with a front end and a rear end in relation to a straight ahead forward travel direction, a wheel arrangement, which is arranged on the chassis in the region of the rear end, and a cleaning head, which is pivotably arranged on the chassis in the region of the front end, wherein there is provided a steering rod device, which is articulated on the cleaning head, which is supported on the chassis and which extends upwardly in a direction away from the chassis toward the rear end.

45 Claims, 11 Drawing Sheets

(56) References Cited

FOREIGN PATENT DOCUMENTS

| | | |
|---|---|---|
| EP | 0 800 783 | 8/2001 |
| EP | 1 344 484 | 9/2003 |
| EP | 2 248 455 | 11/2010 |
| JP | 2008220898 | 9/2008 |
| WO | WO 98/48685 | 11/1998 |
| WO | WO 2004/073477 | 9/2004 |

MANUALLY GUIDED FLOOR CLEANING MACHINE

CROSS-REFERENCE TO RELATED APPLICATIONS

This application is a continuation of international application number PCT/EP2011/069239, filed on Nov. 2, 2011, which is incorporated herein by reference in its entirety and for all purposes.

BACKGROUND OF THE INVENTION

The invention relates to a manually guided floor cleaning machine, comprising a chassis with a front end and a rear end in relation to a straight ahead forward travel direction, a wheel arrangement, which is arranged on the chassis in the region of the rear end, and a cleaning head, which is pivotably arranged on the chassis in the region of the front end.

A floor treatment machine with a driven floor treatment arrangement with a non-circular treatment face is known from WO 98/43527 A1 or EP 0 926 976 B1, which comprises at least one treatment body that is pivotable about a vertical axis in relation to the floor treatment machine. The floor treatment device has a non-circular treatment face, the width extent of which is oriented transverse to the travel direction. The floor treatment device is pivotable depending on the respective travel direction with its non-circular treatment face about a vertical rotational axis relative to the machine body, in such a way that even when negotiating curves, the width extent of the treatment body in each case remains oriented transversely to the current travel direction.

A drivable carriage with at least one pivotable running wheel and/or a pivotable actuating, working or cleaning unit as well as at least one sensor device is known from EP 1 239 762 B1. The sensor device is arranged in such a way that it is pivotable, at least relatively, with the steerable running wheel and/or the pivotable actuating, working or cleaning unit in the same pivoting direction.

A floor scrubber operated from behind is known from WO 2004/073477 A1, which comprises a front region with a first wheel pair and a scrubbing head. A rear region is provided having a second wheel pair. The front region and the rear region are pivotably connected to one another by means of a corresponding mechanism, with a vertical pivot axis. A tank for cleaning liquid is provided. Furthermore, a dirty water tank is provided. An operator can bring about a relative rotary movement between the front region and the rear region by means of a steering system. A motor system drives the first wheel pair or the second wheel pair.

There is known from U.S. Pat. No. 4,010,507 a floor cleaning machine, which has a seat and a steering device, steering taking place by means of the application of pressure on a handle or on a foot pedal of a yoke arrangement.

A floor treatment machine with a variable working width is known from DE 43 37 633 C2, comprising a machine body and an operating device to handle said machine, a floor treatment device, which comprises a treatment body, with a non-circular overall treatment face being provided on the lower side of the machine body. The operating device is position-variable with respect to the machine body in a substantially horizontal plane.

A portable polishing device is known from U.S. Pat. No. 4,499,624.

An electrically driven hand-held scrubbing machine is known from U.S. Pat. No. 4,005,502.

A carpet scrubbing machine is known from U.S. Pat. No. 2,842,788.

A floor treatment machine is known from EP 1 344 484 A2.

SUMMARY OF THE INVENTION

In accordance with the present invention, a manually guided floor cleaning machine is provided, which is compactly constructed and can be easily operated.

In accordance with an embodiment of the invention, in the floor cleaning machine a steering rod device is provided, which is articulated to the cleaning head, which is supported on the chassis and which extends upwardly in a direction away from the chassis toward the rear end.

An operator standing behind the floor cleaning machine and following it can directly bring about a pivotability of the cleaning head by means of the steering rod device and therefore a direction change during a travel movement of the floor cleaning machine. No intermediate elements are then necessary for the steering control of the floor cleaning machine and the latter can be compactly constructed.

Furthermore, the steering rod device can be used directly for pushing or pulling the floor cleaning machine. The steering rod device also forms a pushing rod device or pulling rod device.

The steering rod device can basically be formed with minimized dimensions, in that a one-part or multi-part steering rod is used. This has a small space requirement and corresponding components of the floor cleaning machine can be arranged around the steering rod device and under it. This in turn produces a compact construction with this construction being able to be optimized. A relatively heavy battery device can, for example, be arranged directly above the wheel arrangement.

The steering rod device can be arranged in a structurally simple manner in such a way that it is positively guided and can only carry out a pivoting movement for a pivoting movement of the cleaning head. A pivoting movement of the steering rod device can then be converted by means of direct coupling to the cleaning head into the pivoting thereof. The structural outlay is minimized.

In particular, the steering rod device is oriented, at least in portions, at an acute angle to a level base when the floor cleaning machine is standing with the wheel arrangement and the cleaning head on the level base. The steering rod device is then guided away steeply upwardly. This allows a compact construction to be achieved.

In particular, the acute angle is in the range between 30° and 60° and, in particular, in the range between 40° and 50° and, in particular, at least approximately 45°. As a result, an optimized compact construction is produced, wherein the steering rod device is usable advantageously as a pushing rod device or pulling rod device.

Basically, the steering rod device can be multi-part, for example with a first rod element and a second rod element. It is then basically possible for the first rod element and the second rod element to be oriented at different acute angles to the base (and therefore the chassis). In a preferred solution, the steering rod device is coaxial during the cleaning operation (the first rod element and the second rod element have a zero angle in relation to one another).

In particular, a steering wheel arrangement is arranged on the steering rod device on or close to an end, which is remote from an articulation point on the cleaning head. An operator can then bring about a steering movement in an ergonomically advantageous manner and, in particular, an optimized handle area is then also provided in order to be able to carry out a pushing movement or pulling movement of the entire floor cleaning machine. In the simplest case, the steering wheel arrangement is configured as a cross-bar.

It is quite particularly advantageous if the steering wheel arrangement, in a projection onto a base, on which the floor cleaning machine is standing, projects beyond the rear end of the chassis. An operator, who is standing or walking behind the floor cleaning machine, can then operate the floor cleaning machine by means of the steering wheel arrangement (in particular steer and push it). In particular, the steering wheel arrangement projects so far out that an operator's feet do not hit the floor cleaning machine during a treatment process of this type.

In one embodiment, it is provided that the steering rod device is fixably longitudinally variable and/or is pivotable with respect to the chassis, the steering rod device as a whole being pivotable and/or parts of the parts of the steering rod device being pivotable relative to one another. The steering rod device can then be adapted in an optimized manner to the special ergonomic requirements of an operator in order to allow work with the floor cleaning machine with little fatigue. Furthermore, the steering rod device can then also be positioned in such a way that the outer dimensions of the manually guided floor cleaning machine are minimized for transportation or storage. It is particularly advantageous if the steering rod device is both fixably longitudinally variable and also fixably pivotable and, in particular, parts of the steering rod device can be pivoted relative to one another.

It is favorable if a pivot axis of a pivot bearing for the pivotability of the steering rod device is oriented at least approximately parallel to a rotational axis of a brush roller of the cleaning head and/or to a wheel axis of the wheel arrangement in a position of the steering rod device for the straight ahead forward travel direction. This allows a height adaptation to be easily achieved. Furthermore, it can thereby be achieved, for example, that the steering rod device is foldable (with, for example, two parts that can be pivoted relative to one another). As a result, the height of a rear end of the steering rod device can in turn be adjusted relative to the chassis and, in particular, also adjusted in such a way that the outer dimensions are minimized for transportation and storage.

It is furthermore favorable if a pivot bearing is positioned on the steering rod device above (in relation to the direction of gravity when the floor cleaning machine is standing on a level base) a tank, past which the steering rod device is guided and/or is positioned outside a housing casing arranged on the chassis. As a result, a pivotability of the steering rod device can be achieved with minimized outlay. The casing of the floor cleaning machine, through which the steering rod device passes can be configured with minimized structural outlay as no pivotability of the part of the steering rod device, which passes through the casing or is guided past the tank, has to be provided. Furthermore, the fixing of the pivotability can easily be achieved. An operator can directly access the pivot bearing from outside in order to release the pivotability or fix the pivotability.

In one embodiment, the steering rod device has a sleeve, on which a steering wheel arrangement is arranged, a rod element of the steering rod device being inserted in the sleeve, and a longitudinal position of the sleeve being fixably variable on the rod element. A longitudinally variable steering rod device can thus be easily realized. The guidance of electric cables and the like within the steering rod device is minimally influenced by the longitudinal variability. By means of the sleeve, the steering wheel arrangement is to a certain extent placed on the rod element and held there. At the same time, a telescopic guidance with a longitudinal variability of the steering rod device can easily be configured.

It is quite particularly advantageous if the steering rod device forms a pushing rod device to push the floor cleaning machine and/or forms a pulling rod device to pull the floor cleaning machine. This produces optimized working possibilities with a compact structure of the floor cleaning machine.

The steering rod device is advantageously articulated by a joint device to the cleaning head and, in particular, the joint device comprises a cardan joint. The steering rod device has a pivot axis that is oriented in a different direction to the pivot axis of the cleaning head. The two pivot axes intersect one another, in particular. A pivoting movement of the steering rod device and a pivoting movement of the cleaning head can be implemented by the joint device.

In a structurally favorable embodiment, the joint device is arranged on a pivot bearing for the pivotability of the cleaning head on the chassis. This produces a compact structure. It can easily be achieved that a pivot axis of the steering device and the pivot axis of the pivot bearing intersect so no transverse offset is present.

It is quite particularly advantageous if at least one support element is non-rotatably arranged on the chassis, said support element having a recess, through which the steering rod device is inserted and in which the steering rod device is rotatable. The support element, on the one hand, ensures a support and therefore retention of the steering rod device relative to the chassis. Furthermore, constraints are placed on the steering rod device by a support element of this type so only a rotation about a pivot axis is still possible.

In particular, the steering rod device has a one-part or multi-part steering rod, which is articulated to the cleaning head. This produces a simple and compact structure, the space requirement for the steering rod device being minimized.

In one embodiment, the chassis has a holding element, on which the cleaning head is pivotably arranged and, in particular, the holding element is formed as a holding plate or comprises a holding plate. The holding element is the basic part of the chassis, on which the corresponding components are directly or indirectly fixed.

It is favorable if a first tank and a second tank are arranged on the holding element, the first tank being seated on a first side of the holding element and the second tank being seated on a second side opposite the first side, and the second side facing a base, on which the floor cleaning machine is standing. This produces a compact construction of the floor cleaning machine with optimized utilization of space. Floor areas close to the wall can in turn also be cleaned in an optimized manner owing to the compact structure.

The steering rod device is supported here on the first side and rises above the first side, in particular.

The tank is advantageously shaped in such a way that a free space is formed, through which the steering rod device is guided. The steering rod device can thus to a certain extent be guided through the first tank. This in turn produces an optimized use of space and the floor cleaning machine can be constructed to be compact.

Advantageously, the wheel arrangement is arranged on the second side. The "underside" of the chassis can then also be used.

In particular, the second tank is adapted with respect to its shape to the wheel arrangement. This produces an optimized use of space.

The second tank is advantageously shaped in such a way that a free space is formed for the pivotability of the cleaning head. As a result, the latter can be pivoted in a broad pivoting range, which, in particular, is 360° or more. An optimized operability with an optimized cleaning result is in turn also produced in corner regions that are otherwise difficult to access. Furthermore, the cleaning head can be rotated through 180° in relation to a straight ahead forward travel direction in order to realize a backward travel direction.

For example, the first tank is a dirty water tank and the second tank is a tank for cleaning liquid.

It is favorable if a holding device for a battery device is arranged on the chassis, and, in particular, on the holding element of the chassis, the holding device, in particular, being arranged above the wheel arrangement. The battery device generally has a large mass. It can then be arranged in an optimized manner and, in particular, forces can be supported in an optimized manner because of the relatively high mass of the battery device.

It is favorable if the holding device projects upwardly away from a first side of the holding element, the first side being remote from a second side, which faces a base, on which the floor cleaning machine is standing. The holding device can thus be arranged below the steering rod device. The space available thereby can thus be put to optimized use and a compact structure of the floor cleaning machine is produced.

In particular, the holding device has a wall, which is oriented transversely to the first side of the holding element. This wall to a certain extent separates the holding device with the battery device from a "water region" of the floor cleaning machine. A dirty water tank and a turbine device are, for example, arranged in this water region.

It is favorable if the holding device comprises a holding region for a charging apparatus for the battery device, the charging device being arranged nearer than the battery device to the rear end in relation to a direction between the front end and the rear end of the chassis. As a result, the battery device can be arranged and supported above the wheel arrangement in an optimized manner.

It is furthermore favorable if a turbine device for sucking up dirty water, which is in fluidic connection with a dirty water tank and the cleaning head, is arranged on the chassis and, in particular, on a holding element of the chassis. A region below the steering rod device can be put to optimal use thereby in order to position further components of the floor cleaning machine.

It is favorable for the same reason if a pump device, which is in fluidic connection with a cleaning liquid tank and the cleaning head, is arranged on the chassis and, in particular, on a holding element of the chassis. As a result, the pump device can easily be positioned.

The cleaning head advantageously has at least one driven brush and, in particular, brush roller. This driven brush roller can also be used to drive a movement of the floor cleaning machine in order to allow an operator to work with little fatigue.

In particular, a rotational axis of the at least one brush is oriented parallel to a wheel axis of the wheel arrangement in the straight ahead forward travel direction. A travel drive of the floor cleaning machine can thus be achieved (also with a pivoted cleaning head) by means of the rotating brush.

In particular, the steering rod device has a maximum length between an articulation point and the cleaning head and a rear end, which is at least 1.3 times as large as a length of the chassis between the front end and the rear end. As a result, an operator walking behind the floor cleaning machine, ("walk-behind machine"), can bring about a steering movement by means of the steering rod device and optionally also push or pull the floor cleaning machine. Basically, the length of the steering rod device may be variable, in other words, smaller lengths than the maximum length can also be settable in order, for example, to reduce the outer dimensions of the floor cleaning machine for transportation and storage purposes.

In particular, a pivot axis for the pivotability of the cleaning head is oriented transversely and, in particular, perpendicularly to a wheel axis of the wheel arrangement. As a result, by means of a corresponding pivoting, a change of direction of the floor cleaning machine as a whole can be achieved.

It is favorable if, in the straight ahead forward travel direction, a rotational axis of the at least one brush is parallel to a wheel axis of the wheel arrangement. In a configuration of this type it is possible to bring about, or at least to assist, a travel movement of the floor cleaning machine by means of a driven rotation of the at least one brush. This assistance is also present when negotiating a curve and optionally also when travelling backwards. As a result, the expenditure of force for guiding the floor cleaning machine is reduced for an operator.

It is advantageous, if the cleaning head, in relation to the straight ahead forward direction, can be pivoted to the left and/or right by more than 90° and, in particular, by at least 180°. By means of a corresponding high pivoting range, which is, for example, 360° or more, a high degree of maneuverability is obtained and even corner regions that are difficult to access can be cleaned. Furthermore, the cleaning head can be brought into a backward travel position in relation to the forward travel direction.

In particular, the cleaning head can be pivoted by more than 180° (to the left and to the right in each case). As a result, an optimized movability of the floor cleaning machine is produced.

It is favorable if a drive device for a brush of the cleaning head has at least one electric motor, which is supplied with electric current by means of a battery device arranged on the chassis. The at least one electric motor drives the rotational movement of the brush (brush roller). As a result, a cleaning process is carried out. This rotational movement can also be used to drive a travel movement of the floor cleaning machine as a whole. Further components of the floor device, such as a suction motor of a turbine device and a pump device can also be supplied with electrical energy by means of the battery device.

It is favorable if an application device for cleaning liquid, which is in fluidic connection with a tank arranged on the chassis, is arranged on the cleaning head. Cleaning liquid can thus be discharged at the cleaning head onto a base to be cleaned.

The application device advantageously has a vessel, which is non-rotatably arranged on the cleaning head and into which at least one pipe, which is in fluidic connection with the tank for cleaning liquid, opens. As a result, the structural outlay to guide cleaning liquid from the tank for cleaning liquid to the pivotable cleaning head can be reduced. No fluid-tight pipe between the cleaning head and the corresponding tank that also follows the pivotability of the cleaning head has to be provided. The vessel provides a large "application area" for cleaning liquid from the corresponding tank. The sealing outlay is thereby reduced. As the vessel is non-rotatably connected to the cleaning head, the sealing outlay is also reduced here.

In particular, a position of a mouth of the at least one pipe into the vessel depends on a pivoting position of the cleaning head relative to the chassis. Depending on the pivoting position of the cleaning head, cleaning liquid is injected at various points of the head into the vessel by means of the pipe.

It is favorable if the vessel is seated by a pivot bearing for the pivotability of the cleaning head on the chassis. As a result, a simpler construction is produced. The pipe runs can be minimized.

In particular, the vessel has an annular region, which surrounds the pivot bearing. A receiving space for cleaning liquid is provided by means of this annular region. This receiving region is a type of buffer space for cleaning liquid.

A suction device, which is in fluidic connection with the tank for dirty water that is arranged on the chassis, is advantageously arranged on the cleaning head. Dirty water can thus be sucked up and received at the cleaning head.

In one embodiment, the suction device comprises at least one suction beam arranged on the cleaning head. The suction beam forms a wiper for cleaning liquid, wiped-off cleaning liquid being sucked up.

It is favorable if a lifting device is provided for the at least one suction beam, which is arranged on the cleaning head. In a non-operating state, the suction beam can be lifted by the lifting device from a base, so the latter is no longer in contact with the base. As a result, wear to the suction beam or damage to the suction beam is prevented or the corresponding danger is at least reduced, in the non-operative operation of the floor cleaning machine.

It is favorable if the lifting device comprises a foot pedal, so an operator can easily bring about a lifting or lifting back of the at least one suction beam.

It is favorable if a sensor or switch is associated with the lifting device, a sensor signal or a switch signal bringing about a start and/or stop of a suction motor. As a result, suction can automatically be switched off or on when the suction beam is brought into a non-operative or operative position.

A roller device having at least a first position and a second position is advantageously arranged on the cleaning head, the floor cleaning machine being supported in the first position on the roller device and the at least one brush not being in contact with a base, on which the floor cleaning machine is standing and, in the second position, the at least one brush acting on the base. In the first position, which is a non-operative position for the floor cleaning machine, the wear to the brushes can then be reduced as the latter do not act on the base. In particular, the first position and the second position can be achieved by means of a lifting device for a suction beam.

The following description of preferred embodiments is used in connection with the drawings to describe the invention in more detail.

DETAILED DESCRIPTION OF THE INVENTION

Figure 1:
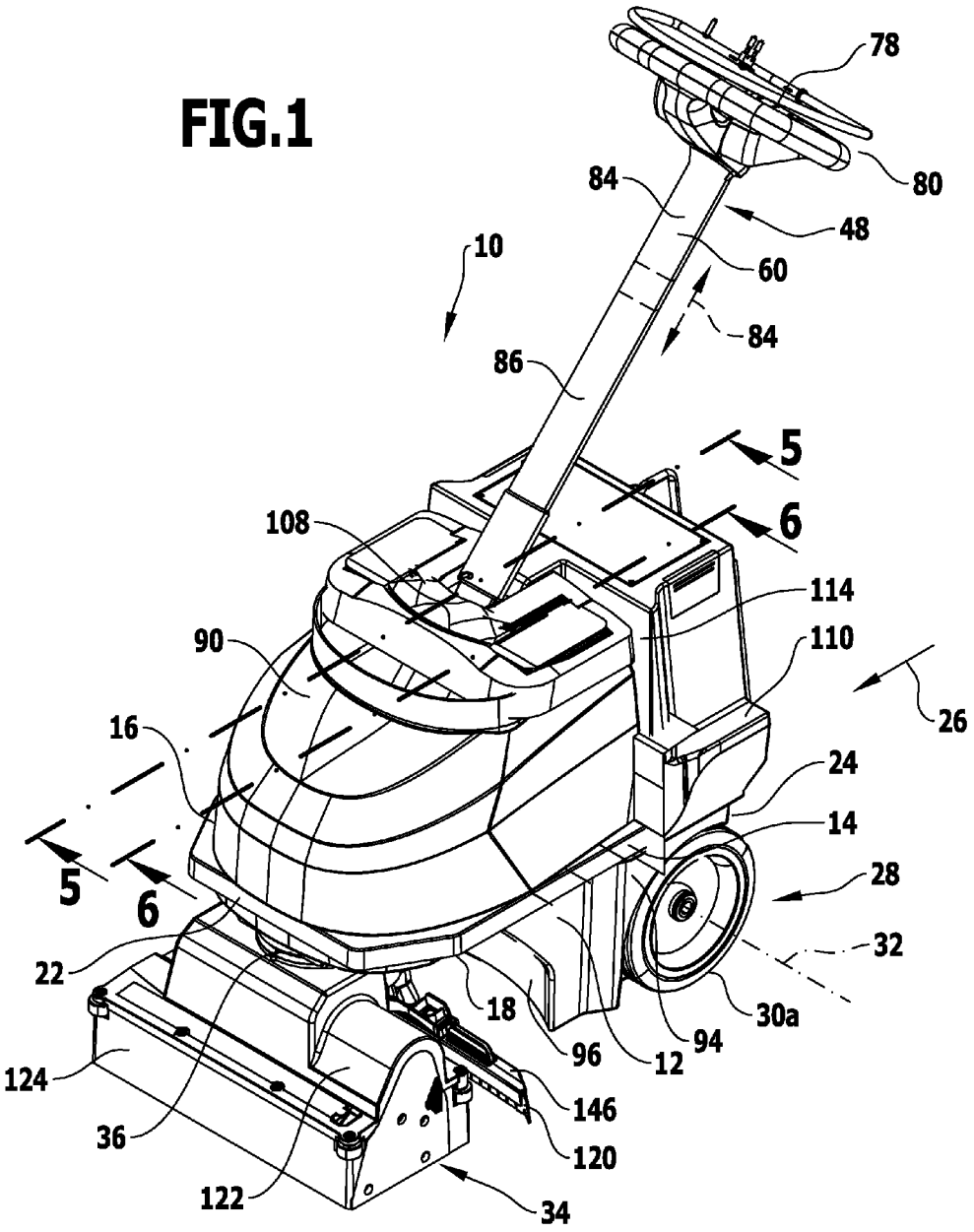
FIG. 1 shows a perspective view of an embodiment of a floor cleaning machine according to the invention.
Figure 2:
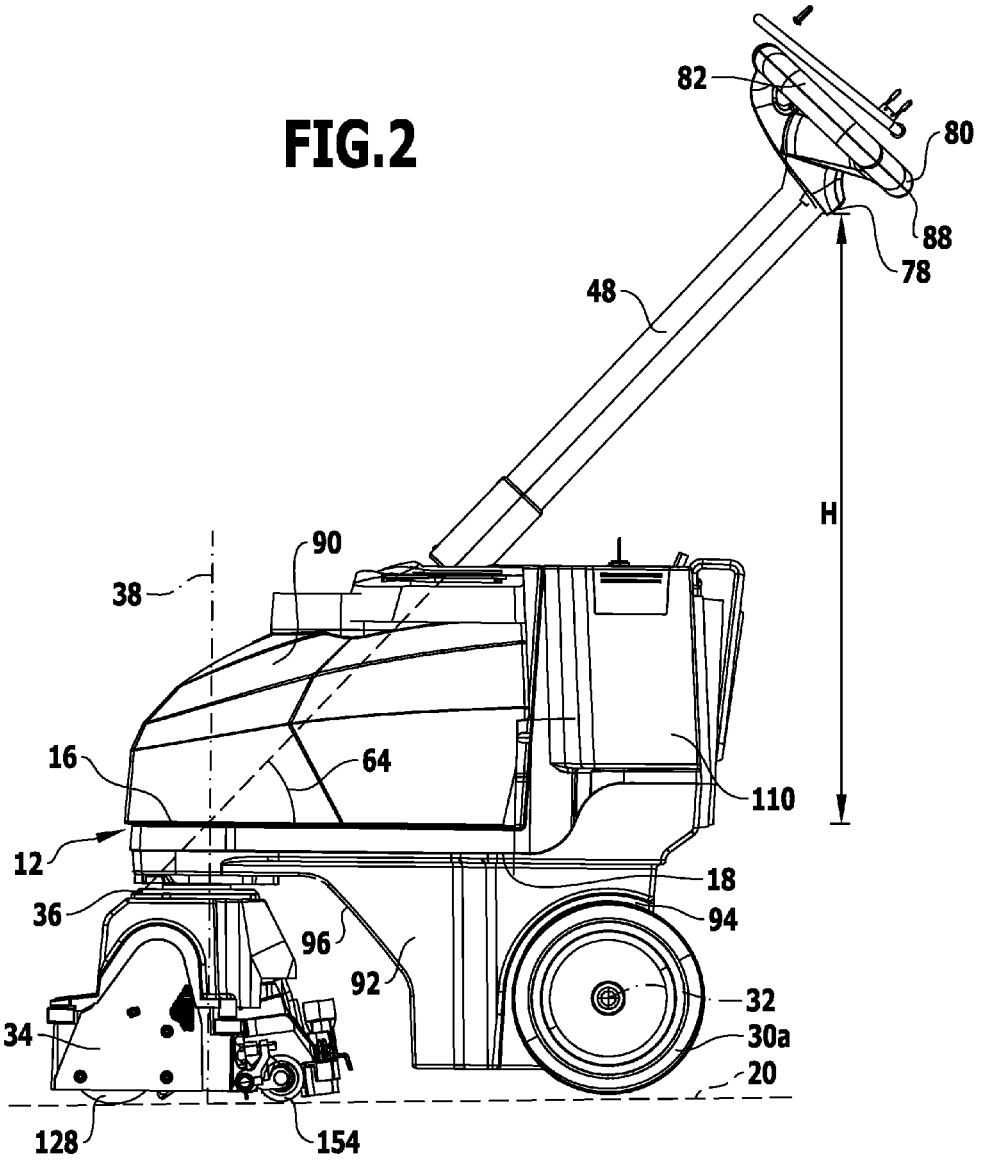
FIG. 2 shows a side view of the floor cleaning machine according to FIG. 1.

An embodiment of a floor cleaning machine according to the invention, which is shown in FIGS. 1 to 10 and designated 10 there, comprises a chassis 12. The chassis 12 has a holding element 14, which is, in particular, configured as a holding plate. The holding element 14, in this case, has a first side 16 and a second side 18 opposite the first side. If the floor cleaning machine 10 is standing on a base 20, the second side 18 then faces the base 20 and the first side 16 is remote from the base 20.

The chassis 12 has a front end 22 and a rear end 24 remote from the front end 22. In a straight ahead forward travel direction 26 of the floor cleaning machine (FIG. 1), the front end 22 is directed to the front and the rear end 24 is directed to the rear. The floor cleaning machine 10 is manually guided. In relation to the straight ahead forward travel direction 26, an operator stands behind the rear end 24 and guides (pushes or pulls) the floor cleaning machine 10, as described in more detail below.

A wheel arrangement 28 is arranged on the chassis 12 in the region of the rear end 24. The wheel arrangement 28 is a rear wheel arrangement, which is positioned on the holding element 14 and, in particular, the second side 18 of the holding element 14. The wheel arrangement 28, in this case, in relation to the straight ahead forward travel direction 26, has a left rear wheel 30*a* and a right rear wheel 30*b* (cf. FIG. 7). The wheel arrangement 28 has a wheel axis 32 (rotational axis), about which the rear wheels 30*a*, 30*b* can be rotated. The wheel arrangement 28 is unsteered, in other words the rear wheels 30*a*, 30*b* only have the movability of the rotatability about the wheel axis 32. The floor cleaning machine 10 is placed by means of the wheel arrangement 28 in the region of the rear end 24 on the base 20.

In the region of the front end 22, a cleaning head 34 is pivotably arranged on the holding element 14. For this purpose, a pivot bearing 36 is provided. This pivot bearing 36 defines a pivot axis 38 (cf. FIG. 2) for the pivotability of the cleaning head 34 on the chassis 12. This pivot axis 38 is oriented transversely and, in particular, perpendicularly, to the wheel axis 32.

In one embodiment, the pivot bearing 36 comprises a cylindrical journal 40, which is arranged in an upper region 42 of the cleaning head 34. The pivot bearing 36 furthermore comprises an annular element 44 with a cylindrical recess 46, which is arranged on the holding element 14. The journal 40 is inserted through the recess 46.

The floor cleaning machine 10 comprises a steering rod device 48. The steering rod device 48 is articulated at one end 50 (cf. in particular FIG. 4) on the cleaning head 34 by means of a joint device 52. The joint device 52 comprises a cardan joint 54.

A fixing device 56 (cf. FIG. 9) for the joint device 52 (and therefore the steering rod device 48) is formed on the journal 40 of the cleaning head 34. The fixing device 56 for example, comprises one or more eyelets 58, on which the joint device 52 can be fixed by means of a bolt or the like. The eyelet 58 in this case projects, in particular, beyond the annular element 44 of the pivot bearing 36, so the rotatability of the cleaning head 34 by means of the journal 40 on the pivot bearing 36 is not hindered. The joint device 52 is thereby arranged on the pivot bearing 36.

The steering rod device 48 comprises a steering rod 60. The steering rod 60 may, in this case, basically be one-part or multi-part. The steering rod 60 has a direction of extent 62. The sheering rod device 48 with the steering rod 60 extends upwardly away from the holding element 14 in the direction of the rear end 24; the steering rod device 48 is articulated on the cleaning head 34, which is arranged in the region of the front end 22 on the chassis 12, in the region of the front end 22. The steering rod 60 lies at an acute angle 64 (cf. FIG. 2) to the chassis 12 and, in particular, to the holding element 14. The acute angle 64 is in relation to the straight ahead forward travel direction 26 or to a level base 20 when the floor cleaning machine 10 is placed thereon. In particular, the acute angle 64 is to the first side 16 of the holding element 14.

The acute angle 64 is in a range between 30° and 60° and in particular between 40° and 50°. In one embodiment, the acute angle 64 is 45°.

Figure 4:
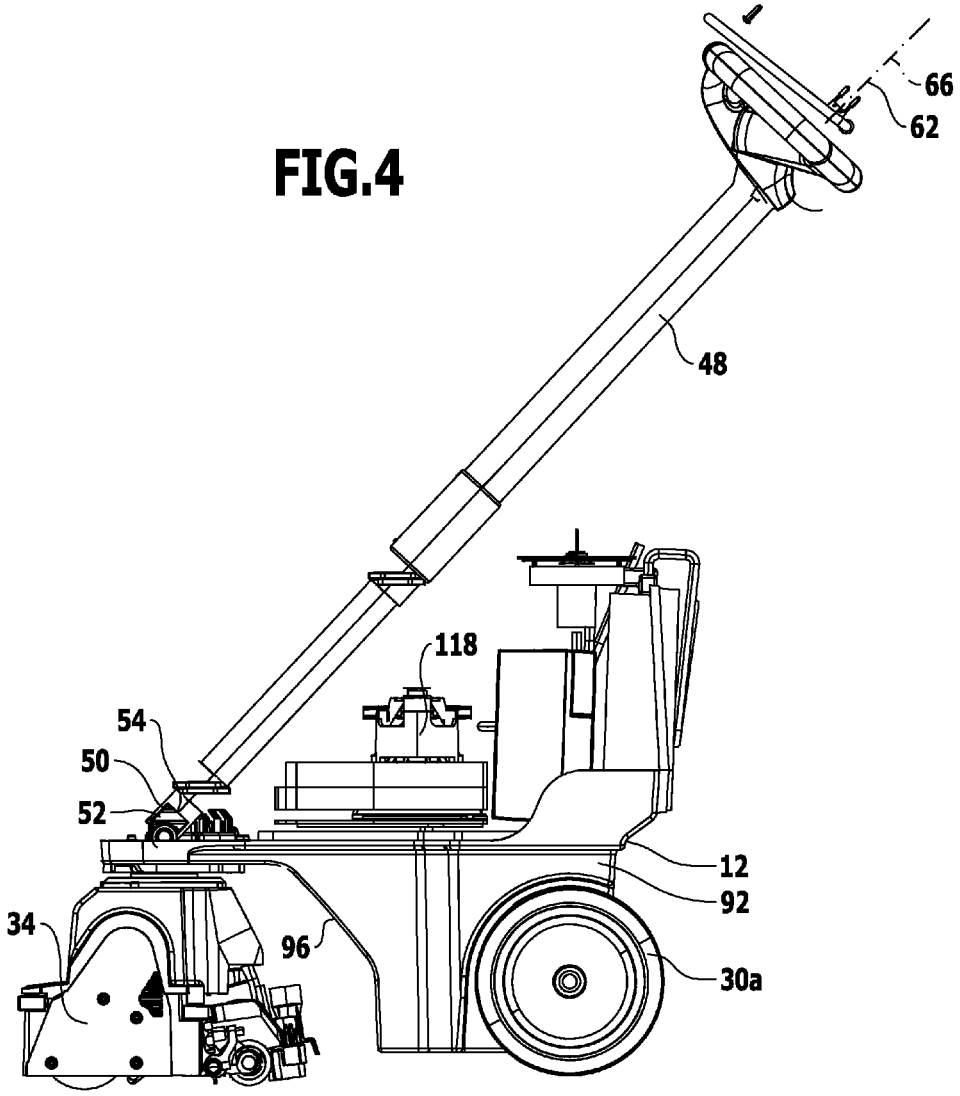
FIG. 4 shows the same view as FIG. 2, further parts having been removed.
Figure 5:
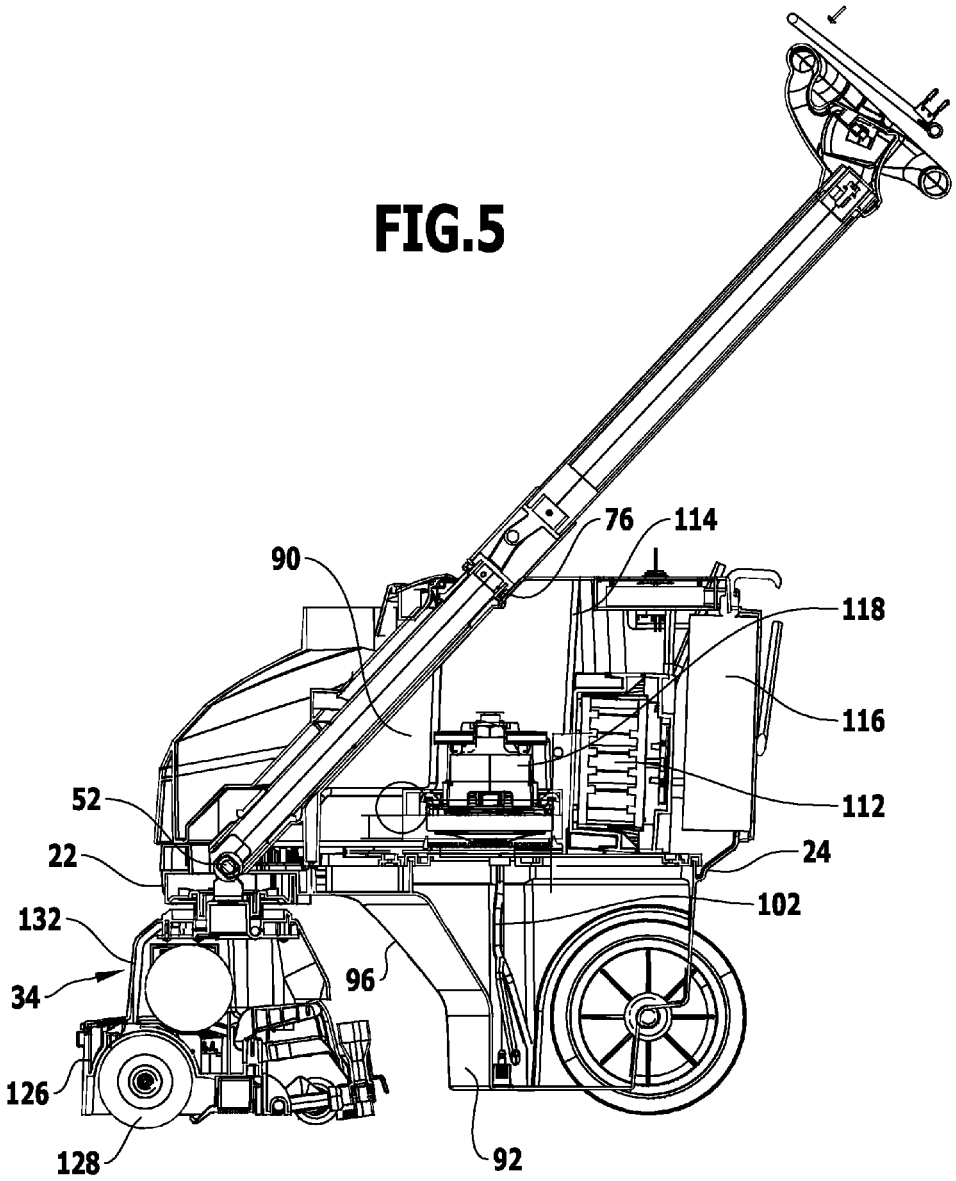
FIG. 5 shows a sectional view in the plane 5-5 according to FIG. 1.
Figure 6:
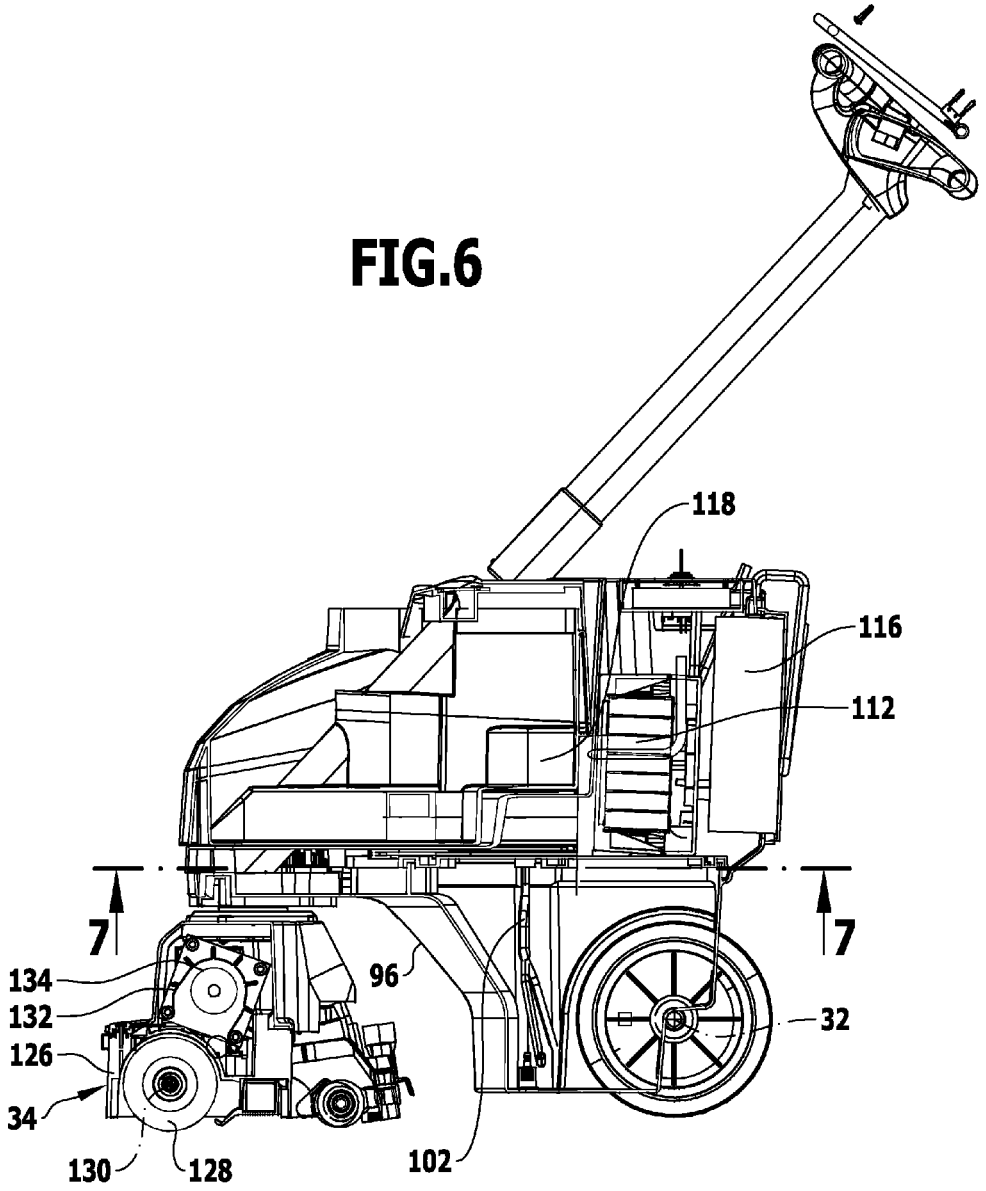
FIG. 6 shows a sectional view in the plane 6-6 according to FIG. 1.
Figure 7:
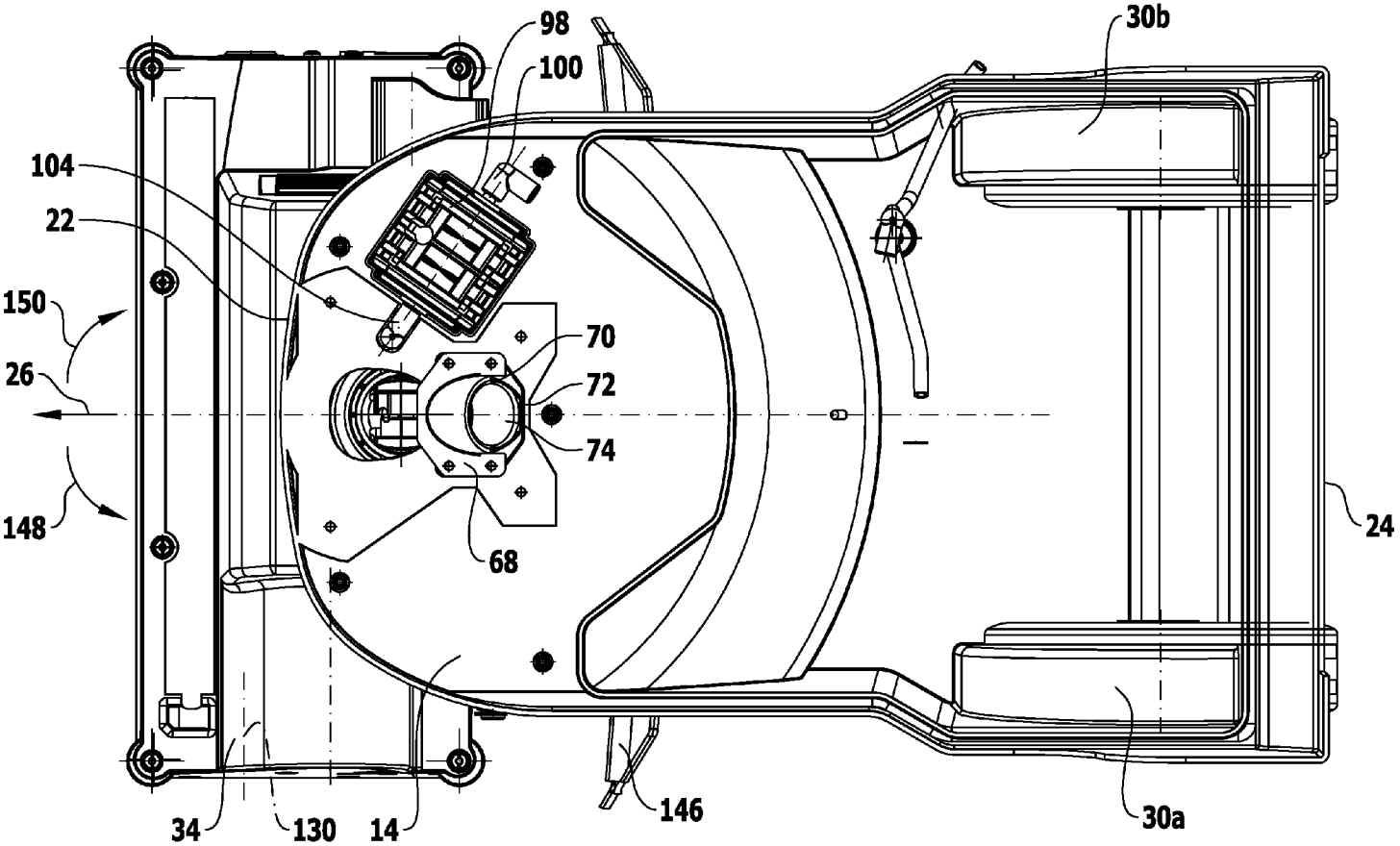
FIG. 7 shows a sectional view along the line 7-7 according to FIG. 6.
Figure 8:
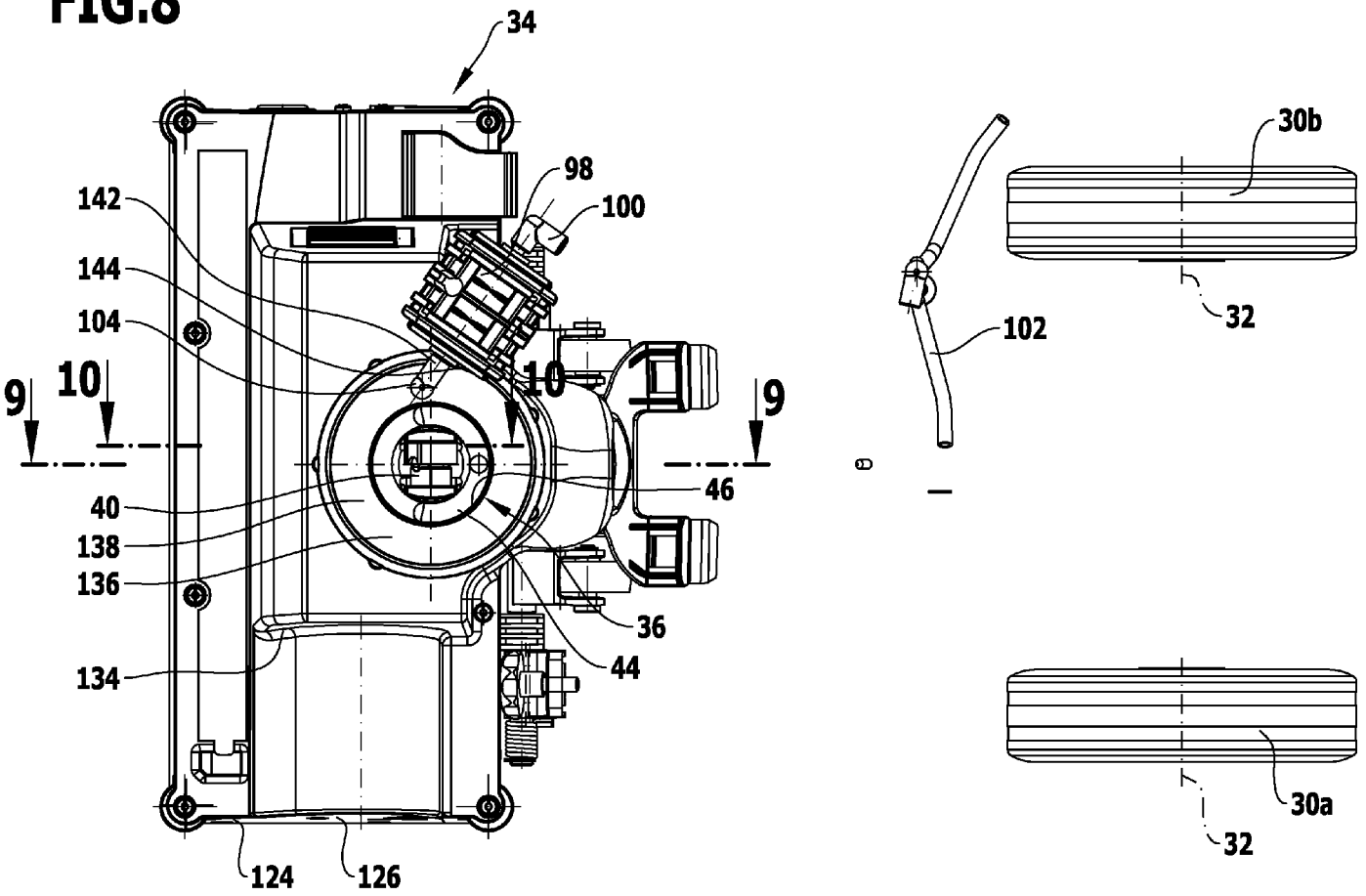
FIG. 8 shows the same view as FIG. 7, parts having been removed.
Figure 9:
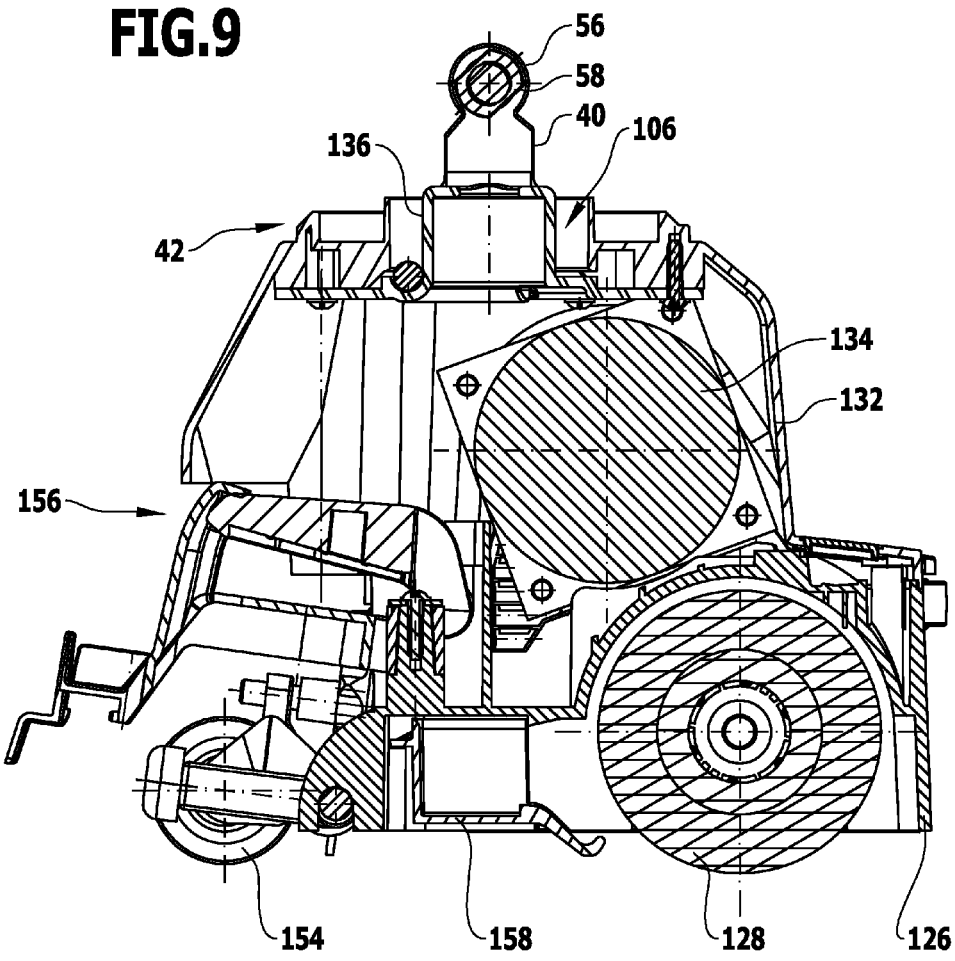
FIG. 9 shows a sectional view along the line 9-9 according to FIG. 8.
Figure 10:
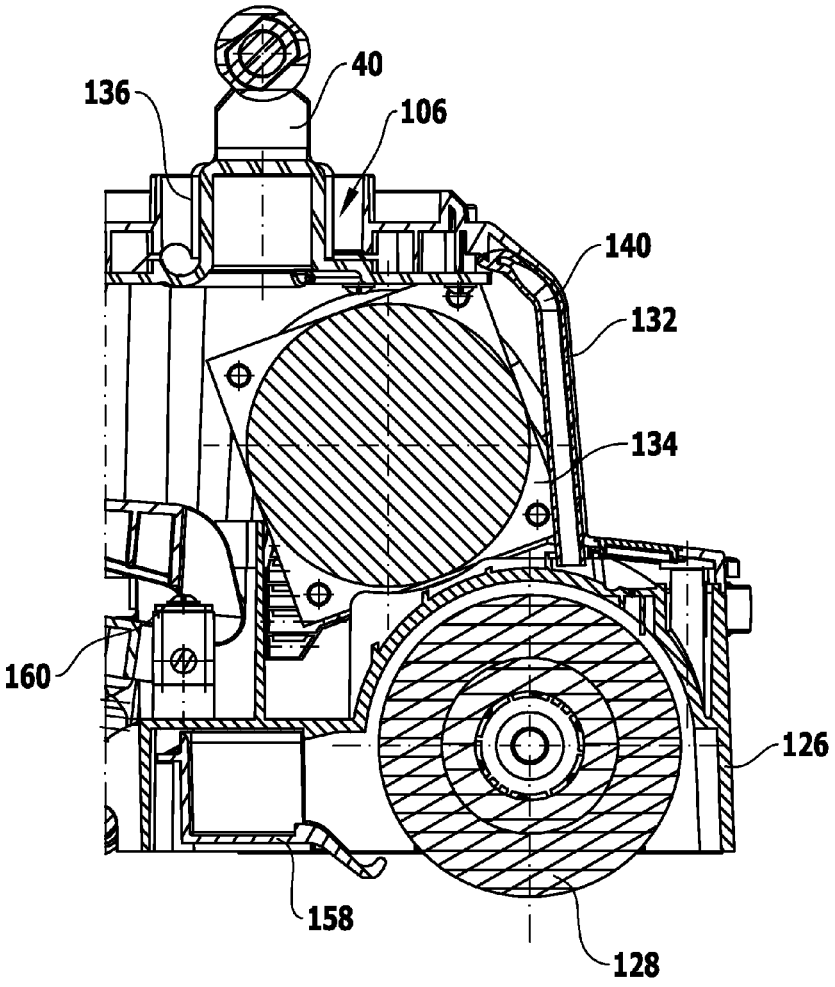
FIG. 10 shows a sectional view along the line 10-10 according to FIG. 8.

The steering rod 60 can be pivoted about a pivot axis 66 (cf. FIG. 4). This pivot axis 66 coincides with the direction of extent 62, in other words, it is at an acute angle 64 to the chassis 12. One or more support elements 68, on which the steering rod device 48 is supported, are seated on the chassis 12. A support element 70 (FIG. 7), which is non-rotatably fixed to the holding element 14 on its first side 16, is provided in the region of the front end 22. This support element comprises an annular element 72 and has a recess 74, through which the steering rod 60 is inserted. The steering rod 60 is rotatably supported about the pivot axis 66 in the recess 74. The annular element 72 for example has the shape of a capped annular cylinder. The steering rod device 48 is rotatably supported close to its end 50 on the chassis 12 by means of the support element 70.

One or more further support elements 76 (cf. FIG. 5) to rotatably support the steering rod device 48 may be provided on the chassis 12, the at least one support element 76 being spaced apart from the support element 70.

The single degree of freedom of movement of the steering rod device 48 is the pivotability about the pivot axis 66. (The pivotability may basically be limited in this case or allow a rotation through 360°.) The movability is limited to this degree of freedom by the support element(s) 70, 76. By means of the joint device 58, the pivoting movement of the steering rod device 48 is transferred to the cleaning head 34 to allow a pivotability of the cleaning head 34 about the pivot axis 38. The cardan joint 54 is formed accordingly. The cardan joint 54 comprises, for example, a universal joint arrangement with, for example, two joints with joint axes lying transversely with respect to one another. In another configuration, the joint device 52 is formed by a gearing device, such as, for example, a crown wheel gearing, bevel wheel gearing or the like.

The steering rod device 48 extends from the front end 50 to a rear end 78. At the front end 50, the steering rod device 48 is articulated in the direct vicinity of the holding element 14 on the cleaning head 34. The rear end 78 has a height spacing H (cf. FIG. 2) from the holding element 14. A sort of triangular structure with an equilateral triangle is thus formed.

A steering wheel arrangement 80 is arranged at the rear end 78. This steering wheel arrangement 80 comprises handle elements 82, which are spaced apart from one another. An operator can then in each case grasp a handle element 82 with the left hand and the right hand in order to actuate the steering rod device 48. In particular, the spaced apart handle elements 82 are connected to one another.

It may be provided that further operating elements of the floor cleaning machine 10 are arranged on the steering wheel arrangement 80.

The rear end 78 of the steering rod device 48, and therefore also the steering wheel arrangement 80, projects beyond the rear end 24 of the chassis 12. A projection of the steering wheel arrangement 80 or the rear end 78 onto the base 20, in relation to the straight ahead forward travel direction 26, lies behind the rear end 24. An operator, during operation of the floor cleaning machine 10, walks behind the rear end 24; the floor cleaning machine 10 is a walk-behind machine. He can grip the steering wheel arrangement 80 on the handle elements 82 and thus bring about corresponding direction changes. The height of the steering wheel arrangement 80 in relation to the base 20 is such, in this case, that at least in relation to an average size of an operator, he can operate the floor cleaning machine 10 with little fatigue. In particular, in relation to the average size, an operator does not need to bend in order to be able to grasp the steering wheel arrangement 80, or does not have to stretch up.

In one embodiment, it is provided that the steering rod device 48 can be adapted to the special conditions of an operator. In particular, the steering rod 60 is multi-part. Its length between the end 50 and the rear end 78 in the extent direction 62 can be fixably adapted. This is indicated in FIG. 1 by the reference numeral 84. For example, the steering rod 60 is multi-part for this purpose, the position of a second part 84 being fixably displaceable relative to a first part 86.

In one embodiment (FIG. 11), the steering rod device 48 comprises a (first) rod element 162. The steering wheel arrangement 80 is arranged on a sleeve 164, this sleeve 164 being placed on the first rod element 162; the sleeve 164 has a recess 166, in which the first rod element 162 is inserted.

The sleeve 164 is fixably displaceable on the first rod element 162. The length of the combination of the first rod element 162 and sleeve 164, and therefore the spacing between the end 50 and the rear end 78 of the steering rod device 48, can thereby be fixably adjusted.

A fixing device designated 168 as a whole is provided. The latter comprises, for example, a clamping lever 170. The clamping lever 170 is, for example, pivotably arranged on the first rod element 162. The sleeve 164 has a slot-shaped recess 172, on which a clamping region 174 of the clamping lever 170 is located. When the clamping region 174 is inactive owing to a corresponding position of the clamping lever 170, the sleeve 164 can be displaced on the first rod element 162. In the region of the recess 172, the sleeve 164 has a contact face 176 for the clamping region 174 of the clamping lever 170.

To adjust the length of the steering rod device 48 between the end 50 and the rear end 78, the clamping lever 170 is released, so the clamping region 174 is in an inactive position. The sleeve 164 can then be pushed on the first rod element 162 into the desired position. The clamping lever is then correspondingly placed therearound, so the clamping region 174 acts on the contact face 176 and a clamping is achieved. The relative position between the sleeve 164 and the first rod element 162 is thereby fixed.

The clamping lever 170 is, in particular, designed in such a way that when it is placed therearound and the clamping region 174 is acting, a self-locking is achieved.

Figure 11:
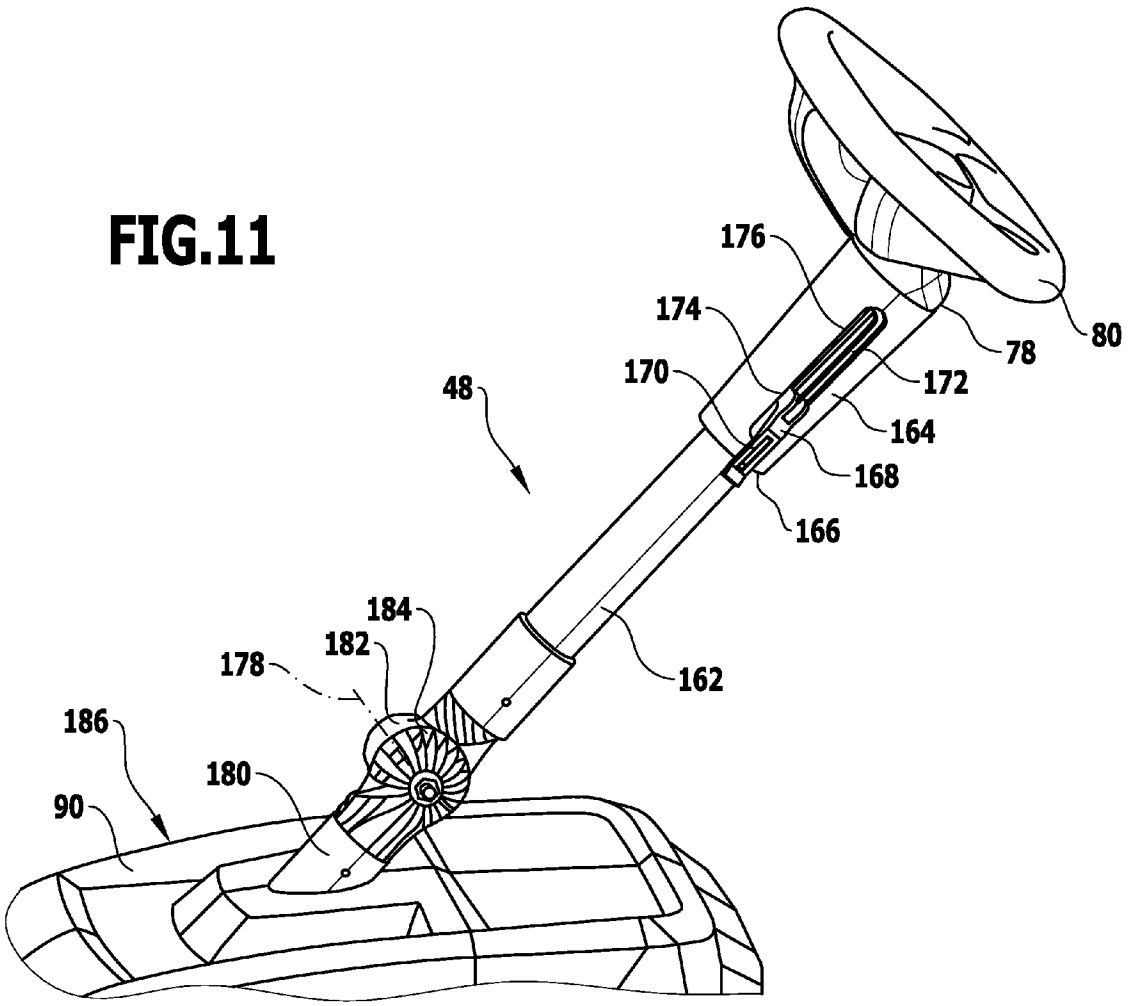
FIG. 11 shows a part view of a variant of a manually guided floor cleaning machine according to the invention with a longitudinally variable and pivotable steering rod device.

Basically it is also possible, (with a corresponding configuration of the joint device 52) for the steering rod device 48 to be arranged in a fixably pivotable manner on the chassis 12 with a pivot axis parallel to the wheel axis 32 when the cleaning head 34 is in the straight ahead forward travel direction 26. In particular, the pivot axis 178 is parallel to a rotational axis 130 of a brush roller 128 of the cleaning head 34 (see below). It may be provided that the steering rod device 48 as a whole is fixably pivotable on the chassis 12. In one embodiment, the steering rod device is pivotable "per se" (FIG. 11). For this purpose, the steering rod device 48 has the first rod element 162 and furthermore has a second rod element 180. This second rod element 180 is provided with the end 50 and connected to the joint device 52. The first rod element 162 and the second rod element 180 are connected by means of a pivot bearing 182. This pivot bearing 182 has a pivot axis 178, which is parallel to the rotational axis 130 of the brush roller 128 or parallel to the wheel axis 32 of the wheel arrangement 28 when the steering rod device 48 is in a rotational position such that the cleaning head 34 is positioned for the straight ahead forward travel direction 26.

A fixing device 184 is associated with the pivot bearing 182. As a result, a relative pivoting position between the first rod element 162 and the second rod element 180 can be fixed. The fixing device 184 has, for example, a clamping device, which clamps the first rod element 162 with the second rod element 180 on the pivot bearing 182. This clamping device comprises, for example, an (in particular manually actuable) clamping screw. Other possibilities for fixing, such as, for example, a latching engagement fixing and the like are also possible.

The pivot bearing 182 (in relation to the direction of gravity when the floor cleaning machine 10 is placed on a level base 20) is located above a first tank 90 (see below), past which the steering rod device 48 is guided. It is furthermore located outside, and in particular above, a housing casing, which is designated 186 as a whole, of the floor cleaning machine 10. In this case, the only movement possibility allowed of the second rod element 180 relative to the chassis 12 is then a rotation about the pivot axis 66.

The pivot bearing 182 is configured in such a way that the second rod element 180 and the first rod element 162 as well as the steering wheel arrangement 80 and the sleeve 164 have the same rotational axis, namely the pivot axis 66. With respect to a pivoting of the pivot axis 66, the second rod element 180 and the first rod element 162 are rigidly connected to one another, even when the fixing device 184 is released.

That part of the steering rod device 48 located above the pivot bearing 182, in comparison to the second rod element 180, when the fixing device 184 is released and the fixing device 168 is released, has further degrees of freedom of movement: the first rod element 162 is pivotable on the pivot bearing 182. That part of the steering rod device located between the pivot bearing 182 and the rear end 78 is longitudinally variable by means of the relative positionability of the sleeve 164 on the first rod element 162.

Basically, it is possible for only one fixable pivotability of the first rod element 182 with respect to the second rod element 180 to be provided or only one longitudinal variability of the steering rod device 48 to be provided. In an advantageous embodiment, the steering rod device 48 is variable with respect to its length and a pivotability is provided on the steering rod device 48.

In the embodiment shown in FIG. 11, the pivot bearing 182 is arranged in such a way that the fixing device 184 is located outside the housing casing 186. Furthermore, the fixing device 168 is arranged in such a way that it is located outside the housing casing 186. An operator can thereby easily and quickly adapt the steering rod device 48 to his requirements.

In particular, a height position of the steering wheel arrangement 80 can be adapted by means of the longitudinal variability. In addition or alternatively, the adaptation can optionally be carried out by adjusting a relative pivoting angle between the second rod element 180 and the first rod element 162. (In this case, the acute angle 64 relates to the second rod element 180.)

It is preferred, in order to achieve simple operability with respect to pushing and pulling the floor cleaning machine 10, for the first rod element 162 and the second rod element 180 to be co-linearly oriented during operation and for the height adaptation to take place by means of the longitudinal variability.

The relative height of the floor cleaning machine 10 can be reduced by means of the pivotability at the gearing rod device 48, by means of which, in particular, the steering rod device 48 is configured to be foldable. As a result, the floor cleaning machine 10 can be brought into a form, which is preferred for transportation processes and storage, in that the second rod element 180 is folded toward the front end 22. In particular, the length of the steering rod device 48 is also minimized, in that the sleeve 164 is displaced into a corresponding position.

The steering rod device 48 projects beyond the rear end 24 of the chassis 12. Basically, the steering wheel arrangement 80, in relation to the straight ahead forward travel direction 26, forms the rearmost point 88 (cf. FIG. 2) of the floor cleaning machine 10. The steering rod device 48, between the end 50 and the end 78, forms a rigid object, which is mounted about the pivot axis 66. The steering rod device 48 thus forms a pushing rod device; by exerting pressure on the steering wheel arrangement 80, an operator can push the floor cleaning machine 10 as a whole. The steering rod device 48 forms a steering device for the floor cleaning machine 10 and a pushing guidance (or pulling guidance in the case of a backward movement) of the floor cleaning machine 10.

A first tank 90 and a second tank 92 are arranged on the chassis 12. The first tank 90 is a dirty water tank. The second tank 92 is a tank for cleaning liquid.

The second tank 92 is arranged on the second side of the holding element 14. It is adapted with respect to its shape to the wheel arrangement 28. It has corresponding free regions 94, the left rear wheel 30*a* and the right rear wheel 30*b* being positioned, in each case, in the free region 94.

Furthermore, the second tank 92 is configured on a side 96, which faces the cleaning head 34 in such a way that a pivotability of the cleaning head 34 about the pivot axis 38 is made possible within a specific pivoting range, this pivoting range comprising at least 180° to the left and right in relation to the straight ahead forward travel direction 26. This will be described in more detail below.

The second tank 92 is configured in such a way that it can receive an optimized quantity of cleaning liquid and does not thus limit the pivotability of the cleaning head 34, which can be pivoted below the holding element 14.

A pump device 98 (cf. FIG. 7) is arranged on the chassis 12. The pump device is fluidically connected by a suction side 100 to the second tank 92. From the suction side 100 of the pump device 98, a suction line 102 leads into the tank 92 in order to suck up cleaning liquid. By a pressure side 104, the pump device 98 is in fluidic connection with an application device 106 for cleaning liquid of the cleaning head 34, as will be described in more detail below.

The first tank 90 for dirty water is arranged on the first side 16 of the holding element 14. It is configured here in such a way that it is adapted with respect to its shape to the guidance of the steering rod device 48. It has a free space 108, through which the steering rod device 48 is inserted.

Figure 3:
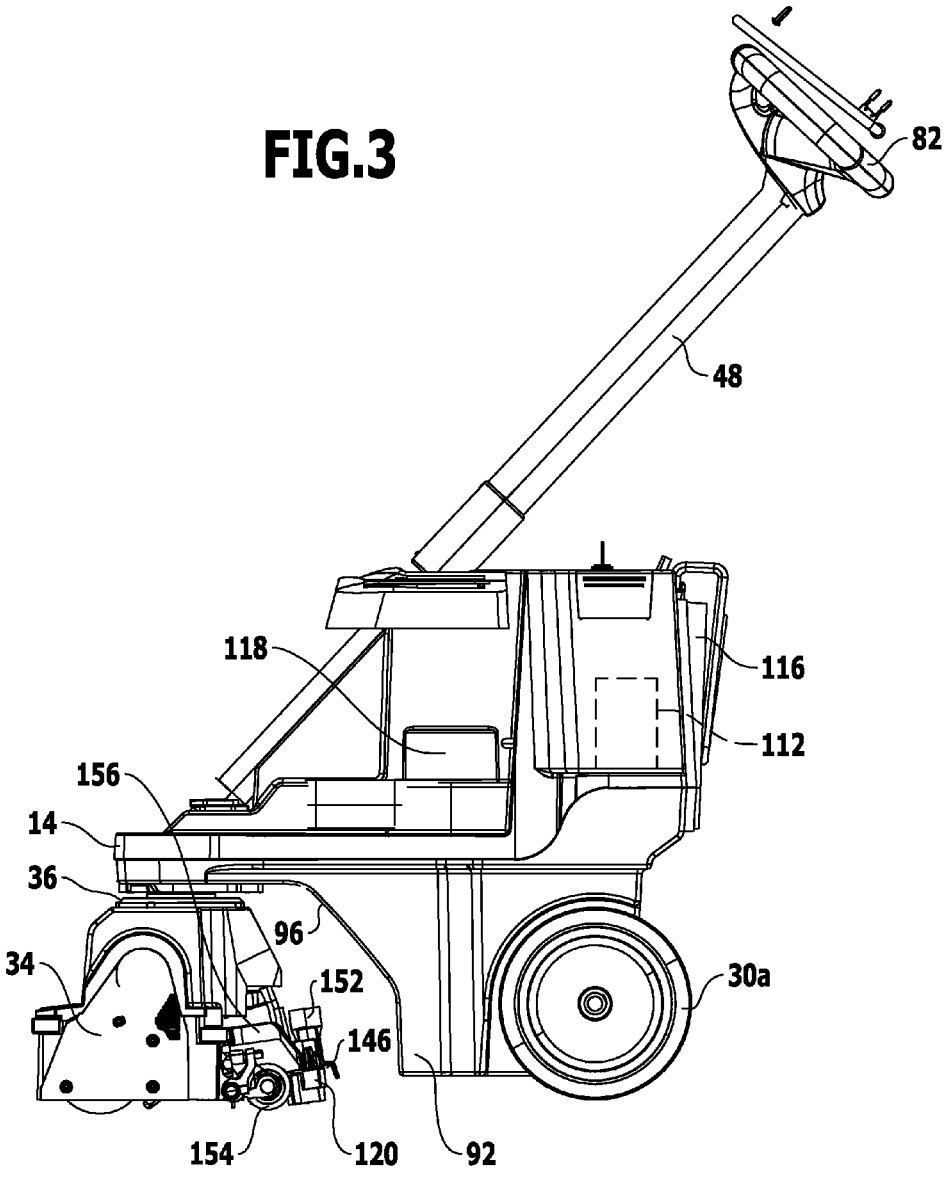
FIG. 3 shows the same view as FIG. 2, parts of the floor cleaning machine having been removed.

Arranged on the holding element 14 is a holding device 110, which holds a battery device (112) (cf., for example, FIG. 3). The holding device 110 is arranged here above the wheel arrangement 28. The battery device 112, which, in particular, comprises one or more rechargeable batteries, generally has a considerable mass proportion of the total mass of the floor cleaning machine 10. By means of an arrangement on the holding element 14 directly above the wheel arrangement 28, optimized force ratios can be achieved.

The holding device 110 comprises a wall 114 (cf., for example, FIG. 1), which projects transversely and, in particular perpendicularly, beyond the holding element 14 on its first side 16. The wall 114 and the holding device 110 as a whole are configured in such a way that they are positioned spaced apart from the steering rod device 48 below the latter. The wall 114 is a delimitation from a space, in which the first tank 90 (and elements connected thereto) are arranged.

A charging apparatus 116 for the battery device 112 is furthermore rigidly arranged on the holding device 110. The charging apparatus 116 can, in particular, be connected to mains current and, by means of corresponding conversion, ensures the charging of the battery in the battery device 112.

The charging apparatus 116, in relation to the straight ahead forward travel direction 26, is arranged behind the battery device 112, in other words, it is arranged closer than the battery device 112 to an operator who grips the steering wheel arrangement 80.

Arranged between the first tank 90 and the wall 114 below the steering rod device 48 is a turbine device 118 with a suction motor. The turbine is in fluidic connection on a pressure side with the first tank 90; dirty water that has been sucked up is conveyed into the first tank 90. By a suction side, the turbine device 118 is in fluidic connection with a suction device 120 (FIG. 1) of the cleaning head 34.

Arranged between the first tank 92 and the holding device 110 are casing elements, which form a closed housing to protect inner components (such as the turbine device 118, fluid lines, electric lines etc.).

The battery device 112 provides electrical energy for the turbine device 118 with a suction motor, the pump device 98 and a drive device 122 of the cleaning head 34.

The cleaning head 34 comprises a housing 124. The housing 124 has a first housing region 126, which is open at the bottom toward the base 20. A brush 128 (brush roller) is arranged in the first housing region 126. The brush 128 can be rotated about a rotational axis 130. When the cleaning head 34 is in the forward travel direction, in which the floor cleaning machine 10 travels in the straight ahead forward travel direction 26, the rotational axis 130 lies parallel to the wheel axis 32. The rotational axis 130 lies transversely, and in particular perpendicularly, to the pivot axis 38 of the cleaning head 34. The brush 128 is formed by a brush roller with corresponding bristles, which emerge from the region of the first housing region 126, which is open at the bottom, and can act on the base 20 to be cleaned.

A closed second housing region 132 is arranged on the first housing region 126. This second housing region receives the drive device 122 to rotate the brushes 128. The drive device 128 in this case comprises an electric motor 134, which is supplied with electric current by the battery device 112. Lines corresponding thereto from the battery device 112 to the cleaning head 34 are provided.

The electric motor 134 is dimensioned in such a way that owing to the rotation of the brush roller 128, an assistance of the travel drive is also achieved. For example, the electric motor 134 has a power of at least 150 W with a torque of at least 1.0 Nm at 1600 rpm.

Cleaning liquid can be fed to the base 20 in the region of the brush 128 by the application device 106. The application device 106 in this case comprises a vessel 136 (FIG. 8), which is non-rotatably seated on the cleaning head 34. The vessel 136 is arranged here above the second housing region 132. The vessel 136 has an annular receiving space 138, which surrounds the journal 40 of the pivot bearing 36. One or more lines for cleaning liquid lead from the receiving space 138 to the brush (brush roller) 128. The receiving space 138 is correspondingly sealed, so that a fluid path 140 (FIG. 10) is formed in a defined manner and is guided past the electric motor 134.

A pipe 142 with a mouth 144 is connected to the pressure side 104 of the pump device 98. The pipe 142 is, in particular, rigidly configured and, for example, in the form of a connecting piece. The mouth 144 is oriented in such a way that cleaning liquid can lead into the receiving space 138. The position of the line 142 and the mouth 144 with respect to the receiving space 138 depends here on the pivoting position of the cleaning head 34. The pipe 142 and the mouth 144 are arranged and configured in such a way here that in each pivoting position, cleaning liquid, which is provided by means of the pump device 98, flows into the receiving space 138, the angular position of the mouth 144 (as a rotation angle with respect to the pivot axis 30) varying at different pivoting positions. The sealing outlay for injecting cleaning liquid into the application device 106 of the pivotable cleaning head 34 is thereby minimized.

The suction device 120 comprises a suction beam 146, which is arranged on the cleaning head 34 and can be pivoted with the latter. The suction beam 146 extends in a direction parallel to the first housing region 126. In one position of the cleaning head 34, in which the straight ahead forward travel direction 26 is realized, the suction beam 146 is at least approximately parallel to the wheel axis 32. The suction beam 146 is arranged here behind the brush 128, in other words, it is closer than the brush 128 to the rear end 24. In the straight ahead forward travel direction 26, the suction beam 146 is positioned between the brush 128 and the side 96 of the second tank 92.

The free region between the cleaning head 34 and the second tank 92 is configured in such a way here that the cleaning head, proceeding from the straight ahead forward travel direction 26 (cf. FIG. 7*a*), is in each case pivotable to the left (indicated by the reference numeral 148) and to the right (indicated by the reference numeral 150) by more than 90° and preferably at least 180° and, in particular, 180° and more.

A connection 152 for a hose is arranged on the suction beam 146. A corresponding hose leads from the connection 152 to the turbine device 118 in order to be able to inject sucked up dirty water into the first tank 90. The hose (not shown in the drawing) is configured and guided here in such a way that it does not hinder the pivotability of the cleaning head 34.

Arranged on the cleaning head is a roller device 154, which has at least one support roller. The roller device 154 is, in this case, in particular positioned between the brush 128 and the suction beam 146. During a cleaning operation of the floor cleaning machine 10, the latter is supported by the roller device 154 on the base 20, specifically in such a way that a cleaning process can be carried out by the brush 128. The cleaning head 34 with the roller device 154 thus forms a front wheel arrangement of the floor cleaning machine 10.

A lifting device, designated 156 as a whole, is arranged on the cleaning head 34. The roller device 154 can be folded with the suction beam 146 by this lifting device 156. In a first position, which is a non-operative position, it can be achieved that the floor cleaning machine is supported on the roller device 154 in the region of the cleaning head 34 and the brush 128 is thus not in contact with the base 20. Furthermore, the suction beam 146 is then spaced apart from the base 20. In this non-operative position, the floor cleaning machine 10 can be moved, the brush 128 and the suction beam 146 being treated with care as they do not touch the base.

In a second position, which has already been described above, the roller device 154 is fixably folded in such a way that the suction beam 146 and the brush 128 act on the base 20 to be cleaned.

For transfer between the first position and the second position or vice versa, a foot pedal 158 is provided, in particular.

A sensor or switch 160, which detects whether the first position or second position is present, is associated with the cleaning head 34. During the transition from the second position to the first position, a change in the loading on the switch 160 takes place. This can be used in order, in particular, to automatically switch on the suction motor or to switch it off. If an operator mechanically transfers the roller device 154 and the suction beam 146 from the first position (non-operative position) to the second position by means of the foot pedal 158, the suction motor is switched on. If an operator carries out a transfer from the second position into the first position, the suction motor is switched off by means of the switch 160.

The floor cleaning machine 10 according to the invention functions as follows:

An operator can steer and push or pull the floor cleaning machine 10 by means of the steering rod device 48 arranged at the acute angle 34. Thus there results a compact structure, components of the floor cleaning machine 10, such as, for example, the turbine device 118 and the first tank 90 being positioned on and below the steering rod device 48. Elements of the floor cleaning machine 10 with a large mass and, in particular, the battery device 112, can thus be positioned directly above the wheel arrangement 28 and supported accordingly.

The brush 128 of the cleaning head 34 is driven, specifically about a rotational axis 130, which, in the straight ahead forward travel direction 26, is parallel to the wheel axis 32. With a corresponding rotational direction of the brush 128, this drive ensures a forward movement of the floor cleaning machine 10 as a whole. As a result, the pushing movement of the operator is assisted and the exertion of force is reduced for the operator. Work with little fatigue results.

The cleaning head 34, in relation to the straight ahead forward travel direction 26, is pivotable to the left and right by at least 180° and, in particular, by more than 180°. As a result, the cleaning head 34 with the brush 128 can also be guided into corner regions that are difficult to access. Furthermore, a change can be made from a straight ahead forward travel direction 26 to an opposite, driven, backward travel direction (without changing the rotational direction of the electric motor 134).

The steering rod device 48 is, in particular, arranged in a central region in relation to the projection of the holding element 14. It and the steering wheel arrangement 80 do not project beyond a left and right side of the floor cleaning machine 10. This allows the floor cleaning machine 10 to travel into a corner region without the steering limiting the freedom of movement of the floor cleaning machine 10 as a whole (for example by bumping into a wall).

The energy-consuming elements of the floor cleaning machine 10 are supplied with electrical current by means of the battery device 112. This produces a compact, self-sufficiently usable floor cleaning machine, which can be used with little fatigue by an operator and is thus maneuverable, so regions close to the wall and corner regions can also be effectively cleaned. Both an application of cleaning liquid to a base 20 to be cleaned and a sucking up of dirty water take place.

Owing to the positioning of the holding device 110 for the battery device 112, batteries with a high energy density (with a correspondingly high space requirement) can also be used.

The steering rod device 48, between the end 50 and the end 78, has a length that is greater than the length of the chassis 12 between the front end 22 and the rear end 24. In particular, said length of the steering rod device 48 is at least 1.3 times, preferably at least 1.35 times and preferably at least 1.4 times greater than the length of the chassis 12 between the front end 22 and the rear end 24.

LIST OF REFERENCE NUMERALS

10 floor cleaning machine
12 chassis
14 holding element
16 first side
18 second side
20 base
22 front end
24 rear end
26 straight ahead forward travel direction
28 wheel arrangement
30*a* left rear wheel
30*b* right rear wheel
32 wheel axis
34 cleaning head
36 pivot bearing
38 pivot axis
40 journal
42 upper region
44 annular element
46 recess
50 steering rod device
50 end
52 joint device
54 cardan joint
56 fixing device
58 eyelet
60 steering rod
62 direction of extent
64 acute angle
66 pivot axis

68 support element
70 support element
72 annular element
74 recess
76 support element
78 rear end
80 steering wheel arrangement
82 handle element
84 second part
56 first part
88 rearmost point
90 first tank
92 second tank
94 free region
96 side
98 pump device
100 suction side
102 suction line
104 pressure side
106 application device
108 free space
110 holding device
112 battery device
114 wall
116 charging apparatus
118 turbine device
120 suction device
122 drive device
124 housing
126 first housing region
128 brush
130 rotational axis
132 second housing region
134 electric motor
136 vessel
138 receiving space
140 fluid path
142 pipe
144 mouth
146 suction beam
148 "to the left"
150 "to the right"
152 connection
154 roller device
156 lifting device
158 foot pedal
160 switch
162 first rod element
164 sleeve
166 recess
168 fixing device
170 clamping lever
172 recess
174 clamping region
176 contact face
178 pivot axis
180 second rod element
182 pivot bearing
184 fixing device
186 housing casing

The invention claimed is:

1. A manually guided floor cleaning machine, comprising:

a chassis with a front end and a rear end in relation to a straight ahead forward travel direction;

a wheel arrangement, which is arranged on the chassis in the region of the rear end;

a cleaning head, which is pivotably arranged on the chassis in the region of the front end; and a steering rod device, which is articulated on the cleaning head, for effecting a direction change during a travel movement of the floor cleaning machine;

wherein the steering rod device is oriented, at least in portions, at an acute angle with respect to a level base when the floor cleaning machine is standing with the wheel arrangement and the cleaning head on the level base, the acute angle in the range between 30° and 60°;

wherein the steering rod device is supported on the chassis and extends in a direction upwardly away from the chassis toward the rear end; and wherein the steering rod device forms at least one of a pushing rod device for pushing the floor cleaning machine and a pulling rod device for pulling the floor cleaning machine.

2. The manually guided floor cleaning machine according to claim 1, wherein the acute angle is in the range between 40° and 50°.

3. The manually guided floor cleaning machine according to claim 1, wherein a steering wheel arrangement is arranged on the steering rod device at or close to an end, which is remote from an articulation point on the cleaning head.

4. The manually guided floor cleaning machine according to claim 3, wherein the steering wheel arrangement, in a projection onto a base, on which the floor cleaning machine is standing, projects beyond the rear end of the chassis.

5. The manually guided floor cleaning machine according to claim 1, wherein the steering rod device is configured to be at least one of fixably longitudinally variable and fixably pivotable with respect to the chassis, and at least one of (i) the steering rod device is pivotable as a whole and (ii) parts of the steering rod device being pivotable relative to one another.

6. The manually guided floor cleaning machine according to claim 5, wherein a pivot axis of a pivot bearing for the pivotability of the steering rod device is oriented at least approximately parallel to at least one of a rotational axis of a brush roller of the cleaning head and a wheel axis of the wheel arrangement in a position of the steering rod device for the straight ahead forward travel direction.

7. The manually guided floor cleaning machine according to claim 5, wherein a pivot bearing is positioned on the steering rod device above a tank, past which the steering rod device is at least one of guided and positioned outside a housing casing, which is arranged on the chassis.

8. The manually guided floor cleaning machine according to claim 5, wherein the steering rod device has a sleeve, on which a steering wheel arrangement is arranged, and wherein a rod element of the steering rod device is inserted in the sleeve, a longitudinal position of the sleeve being fixably variable on the rod element.

9. The manually guided floor cleaning machine according to claim 1, wherein the steering rod device is articulated to the cleaning head by means of a joint device.

10. The manually guided floor cleaning machine according to claim 9, wherein the joint device is arranged on a pivot bearing for the pivotability of the cleaning head on the chassis.

11. The manually guided floor cleaning machine according to claim 1, wherein at least one support element is non-rotatably arranged on the chassis, said support element having a recess, through which the steering rod device is inserted and in which the steering rod device is rotatable.

12. The manually guided floor cleaning machine according to claim 1, wherein the steering rod device has a one-part or multi-part steering rod, which is articulated on the cleaning head.

13. The manually guided floor cleaning machine according to claim 1, wherein the chassis has a holding element, on which the cleaning head is pivotably arranged.

14. The manually guided floor cleaning machine according to claim 13, wherein a first tank and a second tank are arranged on the holding element, wherein the first tank is seated on a first side of the holding element and the second tank is seated on a second side opposite the first side, and wherein the second side faces a base, on which the floor cleaning machine is standing.

15. The manually guided floor cleaning machine according to claim 14, wherein the steering rod device is supported on the first side.

16. The manually guided floor cleaning machine according to claim 14, wherein the first tank is formed in such a way that a free space is formed, through which the steering rod device is guided.

17. The manually guided floor cleaning machine according to claim 14, wherein the wheel arrangement is arranged on the second side.

18. The manually guided floor cleaning machine according to claim 17, wherein the second tank is adapted with respect to its shape to the wheel arrangement.

19. The manually guided floor cleaning machine according to claim 14, wherein the second tank is shaped in such a way that a free space is formed for the pivotability of the cleaning head.

20. The manually guided floor cleaning machine according to claim 14, wherein the first tank is a dirty water tank and the second tank is a cleaning liquid tank.

21. The manually guided floor cleaning machine according to claim 1, wherein a holding device for a battery device is arranged on the chassis and, in particular, on a holding element of the chassis.

22. The manually guided floor cleaning machine according to claim 21, wherein the holding device projects upwardly away from a first side of the holding element, the first side being remote from a second side, which faces a base, on which the floor cleaning machine is standing.

23. The manually guided floor cleaning machine according to claim 22, wherein the holding device has a wall, which is oriented transversely to the first side of the holding element.

24. The manually guided floor cleaning machine according to claim 21, wherein the holding device comprises a holding region for a charging apparatus for the battery device.

25. The manually guided floor cleaning machine according to claim 1, wherein a turbine device for sucking up dirty water is arranged on the chassis and, in particular, on a holding element of the chassis, the turbine device being in fluidic connection with a dirty water tank and the cleaning head.

26. The manually guided floor cleaning machine according to claim 1, wherein a pump device, which is in fluidic connection with a cleaning liquid tank and the cleaning head, is arranged on the chassis.

27. The manually guided floor cleaning machine according to claim 1, wherein the cleaning head has at least one driven brush.

28. The manually guided floor cleaning machine according to claim 27, wherein in the straight ahead forward travel direction, a rotational axis of the at least one brush is oriented parallel to a wheel axis of the wheel arrangement.

29. The manually guided floor cleaning machine according to claim 1, wherein the steering rod device has a maximum length between an articulation point on the cleaning head and a rear end, said length being at least 1.3 times as great as a length of the chassis between the front end and the rear end.

30. The manually guided floor cleaning machine according to claim 1, wherein a pivot axis for the pivotability of the cleaning head is oriented transversely.

31. The manually guided floor cleaning machine according to claim 1, wherein at least one brush is arranged on the cleaning head and a drive device is arranged for the driven rotation of the at least one brush.

32. The manually guided floor cleaning machine according to claim 1, wherein the cleaning head, in relation to the straight ahead forward travel direction, is pivotable to at least one of the left and the right, in each case by more than 90° and, in particular, by at least 180°.

33. The manually guided floor cleaning machine according to claim 32, wherein the cleaning head is pivotable by more than 180°.

34. The manually guided floor cleaning machine according to claim 31, wherein the drive device has at least one electric motor, which is supplied with electric current by means of a battery device, which is arranged on the chassis.

35. The manually guided floor cleaning machine according to claim 1, wherein there is arranged on the cleaning head an application device for cleaning liquid, which is in fluidic connection with a tank arranged on the chassis.

36. The manually guided floor cleaning machine according to claim 35, wherein the application device has a vessel, which is non-rotatably arranged on the cleaning head and into which at least one pipe opens, which is in fluidic connection with the tank for cleaning liquid.

37. The manually guided floor cleaning machine according to claim 36, wherein a position of a mouth of the at least one pipe into the vessel depends on a pivoting position of the cleaning head relative to the chassis.

38. The manually guided floor cleaning machine according to claim 36, wherein the vessel is seated on a pivot bearing for the pivotability of the cleaning head on the chassis.

39. The manually guided floor cleaning machine according to claim 38, wherein the vessel has an annular region, which surrounds the pivot bearing.

40. The manually guided floor cleaning machine according to claim 1, wherein a suction device is arranged on the cleaning head, said suction device being in fluidic connection with a tank for dirty water, which is arranged on the chassis.

41. The manually guided floor cleaning machine according to claim 40, wherein the suction device comprises at least one suction beam, which is arranged on the cleaning head.

42. The manually guided floor cleaning machine according to claim 41, comprising a lifting device for the at least one suction beam, which lifting device is arranged on the cleaning head.

43. The manually guided floor cleaning machine according to claim 42, wherein the lifting device comprises a foot pedal.

44. The manually guided floor cleaning machine according to claim 42, wherein a sensor or switch is associated with the lifting device, a sensor signal or a switch signal effecting at least one of a start and a stop of a suction motor.

45. The manually guided floor cleaning machine according to claim 1, wherein a roller device is arranged on the cleaning head, said roller device having at least a first position and second position, wherein, in the first position, the floor cleaning machine is supported on the roller device and the at least one brush is not in contact with a base, on which the floor cleaning machine is standing and, in the second position, the at least one brush acts on the base.

* * * * *